United States Patent [19]

Dauphin

[11] Patent Number: 4,786,108

[45] Date of Patent: Nov. 22, 1988

[54] CHAIR, IN PARTICULAR OFFICE CHAIR, WITH A VERTICALLY ADJUSTABLE BACK REST SUPPORT

[75] Inventor: Elke Dauphin, Offenhausen bei Nürnberg, Fed. Rep. of Germany

[73] Assignee: Bürositzmöbelfabrik Friedrich-W. Dauphin GmbH & Co., Offenhausen bei Nürnberg, Fed. Rep. of Germany

[21] Appl. No.: 105,894

[22] Filed: Oct. 2, 1987

[30] Foreign Application Priority Data

Oct. 16, 1986 [DE] Fed. Rep. of Germany ..... 3635244

[51] Int. Cl.[4] ..... A47C 1/00

[52] U.S. Cl. ..... 297/353; 297/410

[58] Field of Search ..... 297/353, 410; 248/408

[56] References Cited

U.S. PATENT DOCUMENTS

| | | | |
|---|---|---|---|
| 3,572,834 | 3/1971 | Herzer | 297/410 |
| 3,656,593 | 4/1972 | Bauer . | |
| 3,711,054 | 1/1973 | Bauer . | |
| 3,837,705 | 9/1974 | Marracciuc | 297/353 |
| 4,012,158 | 3/1977 | Harper | 248/408 |
| 4,466,665 | 8/1984 | Aronowitz et al. | 297/353 |
| 4,604,777 | 8/1986 | Meeks | 297/410 |
| 4,639,039 | 1/1987 | Donovan | 297/410 |
| 4,662,682 | 5/1987 | Maurel | 297/353 |

FOREIGN PATENT DOCUMENTS

| | | |
|---|---|---|
| 0179185 | 3/1985 | Fed. Rep. of Germany . |
| 1824431 | 1/1987 | Fed. Rep. of Germany . |
| 552965 | 8/1974 | Switzerland . |

*Primary Examiner*—Francis K. Zugel

*Attorney, Agent, or Firm*—Browdy and Neimark

[57] ABSTRACT

A chair has a seat and a back rest supported by a back rest support to be vertically adjustable, the back rest support being connected, on the one hand, to the back rest and, on the other hand, to the seat. In order, firstly, to enable a simple and elegant vertical adjustment and, secondly, to design the back rest and the seat to be suitable for packaging and, therefore, for dispatch, the back rest support is telescopically composed of an inner and an outer support member, and an interlocking device for the detachable interlocking of the two support members in varying positions, relative to one another, is provided on the back rest support.

10 Claims, 3 Drawing Sheets

CHAIR, IN PARTICULAR OFFICE CHAIR, WITH A VERTICALLY ADJUSTABLE BACK REST SUPPORT

FIELD OF THE INVENTION

The invention relates to a chair, in particular office chair, having a pedestal, a seat supported thereon and a back rest supported by a back rest support to be vertically adjustable, the back rest support being connected on the one hand to the back rest and on the other hand, to the seat.

BACKGROUND OF THE INVENTION

Published European patent application No. 0 179 185 (corresponding to U.S. patent application Ser. No. 741,247) describes a chair of the afore-mentioned kind. The back rest support of this known chair is designed to be a one-pieced strut and is secured in clamping means provided on the seat, or on the support carrying the latter. After releasing a clamping screw, this back rest support, together with the back rest carried by it, can be shifted vertically and subsequently refastened by manipulating the clamping screw. Such a vertical adjustment of the back rest is complicated. In addition, the structural design does not readily lend itself to being packaged and dispatched because the relatively long back rest support is attached in its entirety to the back rest, this part therefore being very unwieldy.

It is also known to attach the back rest support in one piece to the seat, or the seat support, and to provide a displaceable clamp connection on the back rest itself. In this case, similar difficulties are encountered.

SUMMARY OF THE INVENTION

One object of the invention is to develop a chair of the generic kind in such a way that a simple and elegant vertical adjustment is achieved. A further object of the invention is to develop a chair of the generic kind in such a way that the back rest on the one hand and the seat on the other are suitable for packaging and, therefore, for being dispatched.

This object is met according to the invention in that the back rest support is telescopically composed of an inner and an outer support member, and in that an interlocking device for the detachable interlocking of the two support members in varying positions relative to one another is provided on the back rest support. As a result of the division of the back rest support into its telescopic structure, two relatively short support members are provided, one of which is connected to the seat, or the support carrying the latter, and the other is connected to the back rest. The interlocking device can be released by pressing a button, with the result that vertical adjustment is possible in a very simple manner. This design also permits the tool-free assembly and dismantling of the back rest by means of the telescopic contraction, or extension, of the two support members when the interlocking device is disengaged.

When the interlocking device is detachably pressed into an interlocking position by means of a prestressed spring, the spring serves the purpose of locking the interlocking device. It can also act as extension safeguard preventing an unintentional disengagement of the two telescopic support members during vertical adjustment. In this case, too, a tool-free assembly and dismantling is made possible because, in order to dismantle the two support members, the relevant leg of the spring need merely be held in that position in which the corresponding end of the spring does not engage in the locking recess at the inner support member.

Further advantages and features of the invention will become apparent from the ensuing description of an exemplary embodiment, taken in conjunction with the drawings.

DESCRIPTION OF A PREFERRED EMBODIMENT

Figure 1:
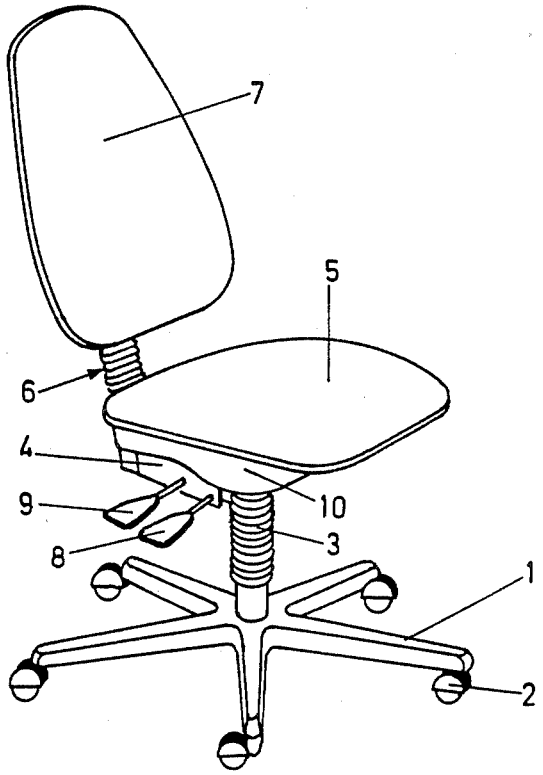
FIG. 1 shows a chair in perspective.

An office chair illustrated in FIG. 1 has a pedestal 1 which is supported on the floor by means of castors 2. Attached to the pedestal 1 is a vertically adjustable column 3, at the upper end of which is attached a seat support 4 to which, in turn, is attached an upholstered seat 5. Attached to the seat support 4 is a substantially upward extending back rest support 6, to the upper end of which is attached a back rest 7. Vertical adjustment of the column 3 is by means of a control lever 8 provided in the seat support 4. A further control lever 9 is provided at the seat support 4 for the purpose of changing the tilt of the back rest 7 with the back rest support 6, if desired with the simultaneous changing of the tilt of the seat 5.

The basic assembly of the office chair described is generally known. The vertically adjustable column 3 is known, for example from U.S. Pat. No. 3,711,054 or U.S. Pat. No. 3,656,593. The assembly of the seat support, including the described tilting means of the back rest 7 and the seat 5, is known, for example, from published European patent application No. 0 179 185 (corresponding to U.S. patent application Ser. No. 741,247). The seat support 4 can be optically concealed, partially or substantially, by a casing 10 secured to the lower side of the seat 5.

The back rest support 6 is telescopically structured, i.e. it is composed of two members, the one guided within the other. The outer support member 11 is connected at its upper end 12 to the back rest 7. The inner support member 13, provided to be longitudinally displaceable within the outer support member, is attached at its lower end to the seat support 4.

Figure 2:
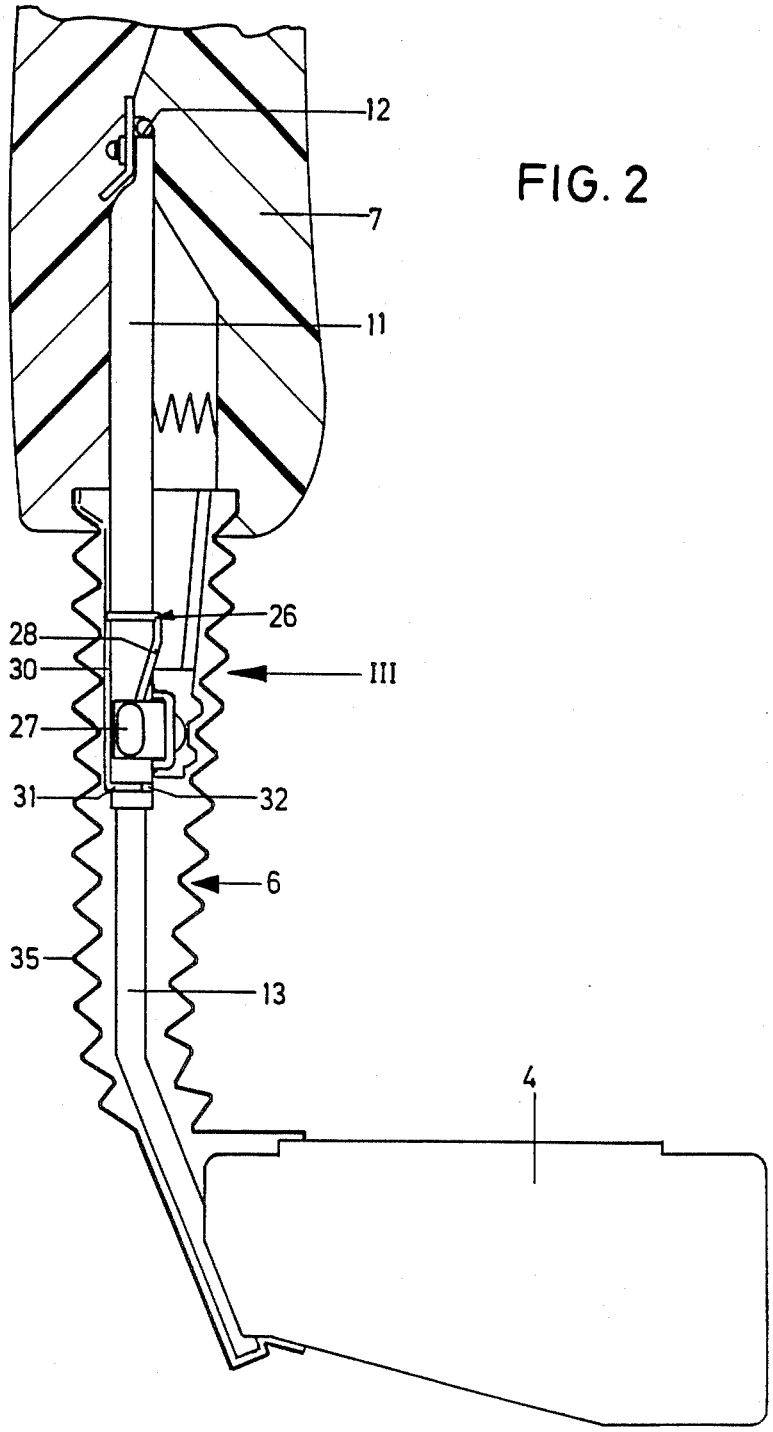
FIG. 2 shows a side view of a back rest support of the chair.
Figure 3:
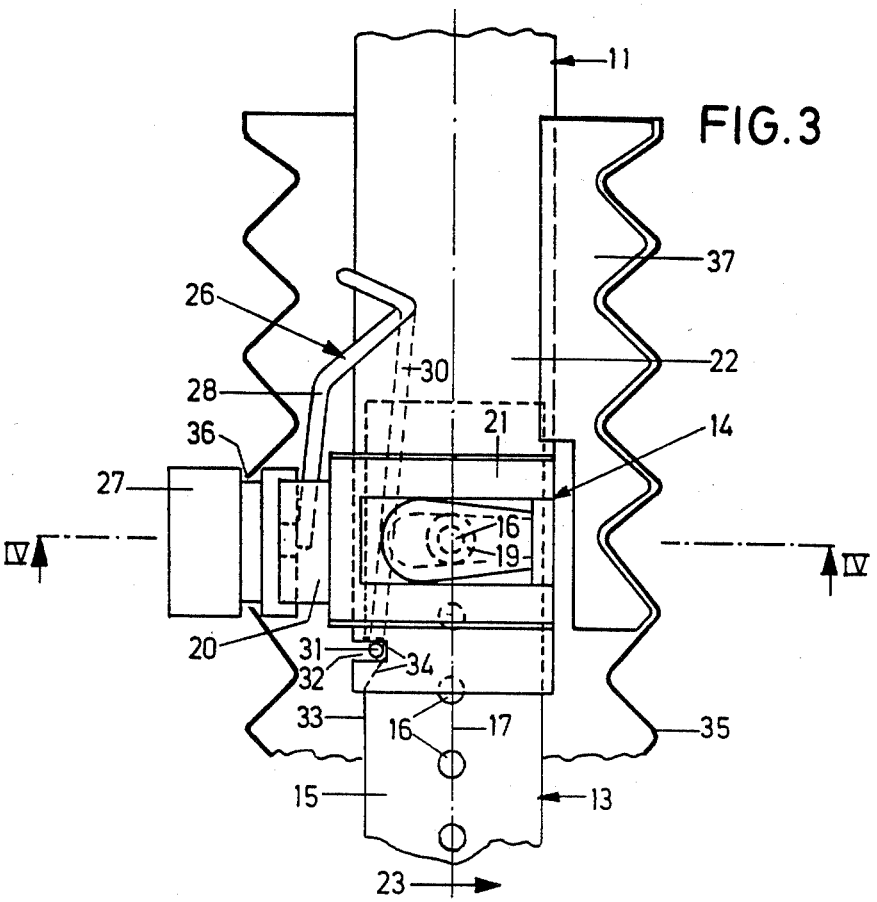
FIG. 3 shows a view of the back rest support in the direction of arrow III of FIG. 2.
Figure 4:
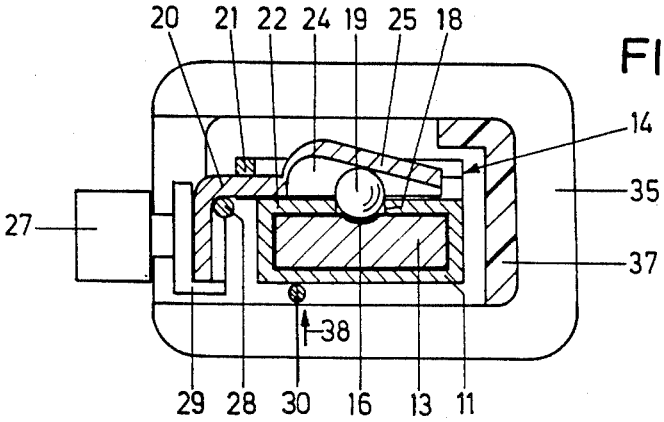
FIG. 4 shows a section through the back rest support in the region of the interlocking device along line IV—IV of FIG. 3.

As can be seen in FIGS. 2 to 4, and in particular in FIG. 4, the cross-section of the two support members 11, 13 is approximately rectangular and matching one another, so that the two members may be displaced relative to one another but they cannot rotate relative to one another.

In order to interlock the two support members 11, 13 which are longitudinally displaceable relative to one another, in a given position, i.e. in order to lock in position a vertical setting of the back rest 7, an interlocking device 14 is provided.

To this end, calotte-shell-shaped recesses 16 are provided on one longitudinal side 15 of the inner support member 13, which recesses are parallel to the common central longitudinal axis 17 of the two support members 11, 13 in that region in which the two support members 11, 13 are displaceable one within the other. In this region, the central longitudinal axis is a straight line.

Coinciding with the row of recesses 16, an aperture 18 is provided in the outer support member 11, in which aperture 18 a ball 19 which can, in each case, enter one recess 16, is arranged. The calotte-shell-shaped recesses 16 and the ball 19 therefore match one another.

Above the ball 19, a slide 20 which is supported in guide rails 21, is provided. These guide rails 21 are attached to the larger outer wall 22 of the outer support member 11 which is associated with the longitudinal side 15 of the inner support 13. The direction of displacement 23 is vertical relative to the axis 17, i.e. horizontal, relative to an even floor as support for the chair, and parallel to the outer wall 22, i.e. also perpendicular to the vertical main plane of symmetry of the chair. The slide 20 is provided with a hollow space 24 which partially accommodates the ball 19, the hollow space 24 being terminated by an inclined part 25 which slopes in the direction of displacement 23.

The slide 20 is stressed by means of a prestressed spring 26 in such a way that it is pressed into a position illustrated in FIGS. 3 and 4, in which position the inclined part 25 presses against the ball 19 in such a way that the latter is pushed into a recess 16 in the inner support member 13. In this position, the inner support member 13 is, therefore, interlocked with the outer support member 11. If the slide 20 is shifted against the force of this spring 26 (to the right, in FIGS. 3 and 4) towards the support members 11, 13, then the hollow space 24 below the inclined part 25 can accommodate the ball 19 to such an extent that it is lifted or pushed out of the corresponding recess 16. In that case, therefore, the interlocked condition between the support members 11, 13 is cancelled and they can be displaced relative to one another in the direction of the axis 17. A control button 27 is provided on the slide 20 for its manipulation.

The spring 26, with one leg 28, rests against an angled-off section 29 of the slide 20 to which the control button 27 is connected. The other leg 30 is supported in a slot 32 in the outer support member by means of an end 31 extending transversely to the outer wall 22.

In the narrow side 33 of the inner support member 13, which side faces the slot 32, there is provided a locking recess 34 in which the end 31 of the leg 30 comes to rest when the end 31 and the locking recess 34 coincide. This locking recess 34 is provided in that region of the inner support member 13 up to where, maximally, vertical adjustment of the back rest support 6 is desired. This prevents the unintentional withdrawal of the back rest 7 with the outer support member 11 from the inner support member 13, i.e. from the chair, if the slide 20 is engaged, i.e. when the interlocking device 14 is open. As a result of the inclined design of the locking recess 34, it is ensured that it is possible to push the outer support member 11 on to the inner support member 13, without the end 31 of the spring 26 settling into this locking recess 34. In order to erect the outer support member 11 on the inner support member 13, it is necessary merely to depress the control button 27 towards the support member 11 so that the ball 19 can withdraw into the hollow space 24. In order that said ball does not fall out through the aperture 18 in the outer wall 22 of the outer support member 11, before assembly of the two support members 11, 13, the diameter of this aperture 18 is slightly smaller than the diameter of the ball 19. For this reason, too, the ball 19 projects into the respective recess 16 in the inner support member 13, when the support members 11, 13 are interlocked, by clearly less than half its diameter. Consequently, when the interlocking device 14 is disengaged, the support members 11, 13 can easily be displaced relative to one another, without the ball 19 being caught in the recess 16. It withdraws very easily into the hollow space 24.

The support members 11, 13 are surrounded by a concertina structure 35 which is fastened, on the one hand, to the back rest 7 and, on the other hand, to the seat support 4. The control button 27 of the slide 20 is directed outward through a corresponding opening 36 in the concertina structure, so that the interlocking device 14 can be activated through the concertina structure 35.

Since the position of the interlocking device 14, relative to the back rest 7, cannot be changed, and since the control button 27 is directed out of the concertina structure through the opening 36 in the latter, the concertina structure 35 is not compressed in the region between the control button 27 and the back rest 7 during vertical adjustment of the back rest 7. With a view to preventing the concertina structure 35 from being drawn askew during vertical adjustments, since it is compressed or extended in the upper region, too, on the side opposite the control button 27, a lining 37 which matches the structure of the concertina structure is provided on the side opposite the control button 27 between the outer support member 11 and the concertina structure 35.

Dismantling of the back rest 7 together with the outer support member 11 from the inner support member 13 when the concertina structure is assembled, is possible by depressing, through the concertina structure 35, the leg 30 of the spring 26 against the outer support member 11 in the direction of the arrow 38 for the exerting of pressure. The slide 20 is subsequently released by pressure exerted on the control button 27, and the back rest 7, together with the outer support member 11, is removed from the inner support member 13. Since the leg 30 is held, its end 31 cannot snap into the locking recess 34 when passing the latter, with the result that the outer support member 11 can be removed completely from the inner support member 13 without the necessity of employing a tool. The concertina structure 35 in this case is as usual manufactured of a soft synthetic material of minimal thickness, i.e. substantially thinner than 1 mm.

The concertina structure 35 can also be designated as concertina walls 35.

What is claimed is:

1. A chair, in particular an office chair, comprising:

a pedestal, a seat supported on said pedestal, a back rest, a back rest support for vertically adjustably supporting said back rest, the back rest support being connected to the back rest and to the seat, said back rest support being telescopically composed of an inner and an outer support member, an interlocking device for detachably interlocking the two support members in varying positions relative to one another provided on the back rest support, and a prestressed spring for detachably pressing the interlocking device into an interlocking position, said spring acting as an extension safeguard for the support members and having one end being flexibly prestressed, entering a slot in the outer support member, wherein said slot is associated with a locking recess in the inner support member.

2. A chair according to claim 1, wherein the interlocking device (14) is formed by a ball notch arrangement wherein a ball (19) held in the outer support member (11) can be pressed, in each case, into one of several recesses (16) in the inner support member (13).

3. A chair according to claim 3, wherein the interlocking device (14) has a slide (20) with an inclined part (25) as abutment for the ball (19).

4. A chair according to claim 3, wherein the slide (20) is pressed by means of the prestressed spring (26) into an interlocked position in which the ball (19) is pressed by means of the inclined part (25) in the direction of the inner support member (13).

5. A chair according to claim 1, wherein the back rest support (6) is surrounded by a concertina structure (35) which extends from the back rest (7) to the seat (5), and through which penetrates a control button (27) of the interlocking device (14).

6. A chair according to claim 5, wherein a lining (37) which matches the concertina structure (35) is arranged on the side of the back rest support (6) which is opposite the control button (27).

7. A chair, in paritcular an office chair, comprising:

a pedestal;

a seat supported on said pedestal;

a back rest;

a back rest support for vertically adjustably supporting said back rest, the back rest support being connected to the back rest and to the seat, said back rest support being telescopically composed of an inner and an outer support member;

an interlocking device for detachably interlocking the two support members in varying positions relative to one another provided on the back rest support, said interlocking device comprising a ball notch arrangement including a ball held in the outer support member adapted to be pressed, in each case, into one of several recesses provided in the inner support member, further comprising a slide having an inclined part as an abutment for the ball; and a prestressed spring for detachably pressing the interlocking device into an interlocking position, wherein the slide is pressed by the prestressed spring into an interlocked position in which the ball is pressed by the inclined part in the direction of the inner support member, and wherein the spring in addition acts as an extension safeguard for the support members.

8. A chair according to claim 7, wherein one end of the spring, being flexibly prestressed, enters a slot in the outer support member, and wherein said slot is associated with a locking recess in the inner support member.

9. A chair according to claim 7, further comprising a concertina structure surrounding the back rest support which extends from the back rest to the seat, and a control button for controlling the interlocking device penetrating through the concertina structure.

10. A chair according to claim 9, further comprising a lining which matches the concertina structure arranged on the side of the back rest support which is opposite the control button.

* * * * *